US010754282B2

(12) United States Patent
Matsuo

(10) Patent No.: US 10,754,282 B2
(45) Date of Patent: Aug. 25, 2020

(54) IMAGE FORMING APPARATUS

(71) Applicant: KONICA MINOLTA, INC., Chiyoda-ku, Tokyo (JP)

(72) Inventor: Masahiro Matsuo, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/504,148

(22) Filed: Jul. 5, 2019

(65) Prior Publication Data

US 2020/0012221 A1 Jan. 9, 2020

(30) Foreign Application Priority Data

Jul. 9, 2018 (JP) ..... 2018-129647

(51) Int. Cl.
*G03G 15/00* (2006.01)
*G03G 15/08* (2006.01)

(52) U.S. Cl.
CPC ..... *G03G 15/5012* (2013.01); *G03G 15/0844* (2013.01); *G03G 15/502* (2013.01); *G03G 15/553* (2013.01); *G03G 15/652* (2013.01)

(58) Field of Classification Search
CPC ..... G03G 15/0844; G03G 15/5012; G03G 15/5016; G03G 15/502; G03G 15/5041; G03G 15/556; G03G 15/6517; G03G 15/652; G03G 15/6526
See application file for complete search history.

(56) References Cited

U.S. PATENT DOCUMENTS

| | | | | |
|---|---|---|---|---|
| 9,274,483 | B2 | 3/2016 | Kiuchi et al. | |
| 2010/0245876 | A1* | 9/2010 | Nakamaru | B41J 15/00 358/1.12 |
| 2015/0071671 | A1 | 3/2015 | Kiuchi et al. | |
| 2017/0052493 | A1* | 2/2017 | Ikeda | G03G 15/6517 |
| 2017/0139361 | A1* | 5/2017 | Nishi | G03G 15/5012 |
| 2017/0277105 | A1* | 9/2017 | Tomino | G03G 15/6529 |
| 2017/0315487 | A1* | 11/2017 | Tomino | G03G 15/5016 |
| 2017/0336744 | A1* | 11/2017 | Noda | G03G 15/5016 |
| 2018/0224784 | A1* | 8/2018 | Katada | G03G 15/50 |
| 2018/0275581 | A1* | 9/2018 | Tomino | G03G 15/5062 |
| 2018/0299814 | A1* | 10/2018 | Matsuo | G03G 15/5062 |

FOREIGN PATENT DOCUMENTS

JP 5741656 B2 5/2015

* cited by examiner

*Primary Examiner* — Carla J Therrien
(74) *Attorney, Agent, or Firm* — Holtz, Holtz, Volek PC

(57) ABSTRACT

An image forming apparatus includes an image former, an informing unit, and a hardware processor. The image former prints an image on continuous paper by: forming an electrostatic latent image on an image holder based on image information of a job; developing the electrostatic latent image with toner, thereby forming a toner image on the image holder; and transferring the toner image onto the continuous paper. Based on the image information of the job, the hardware processor calculates a coverage of the image to be printed on the continuous paper. Based on the calculated coverage, the hardware processor determines a continuously printable distance on the continuous paper. The hardware processor causes the informing unit to inform a user of the continuously printable distance before the image former starts the printing.

13 Claims, 5 Drawing Sheets

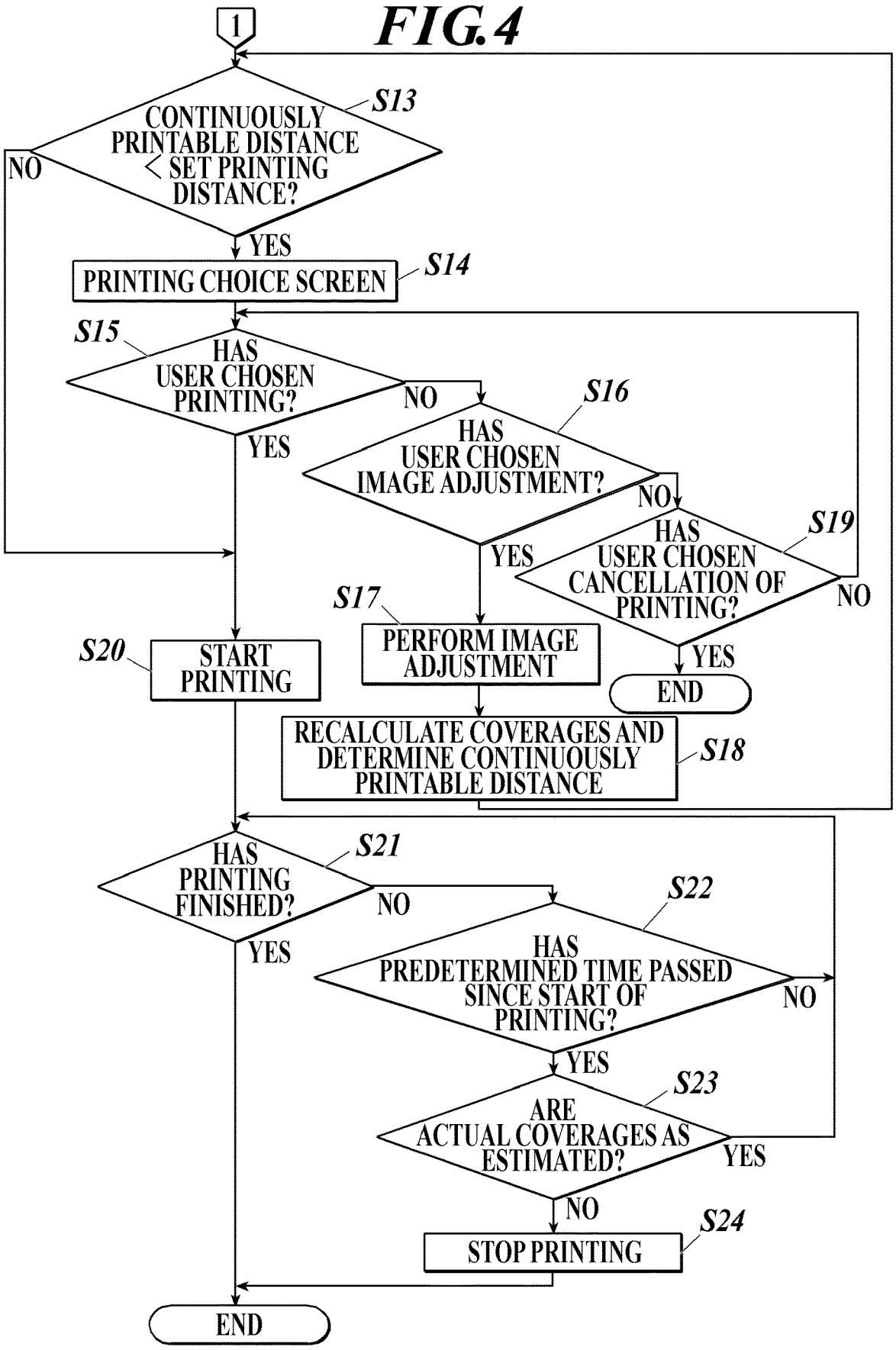
FIG. 4
1
S13
CONTINUOUSLY PRINTABLE DISTANCE < SET PRINTING DISTANCE?
NO
YES
PRINTING CHOICE SCREEN
S14
S15
HAS USER CHOSEN PRINTING?
NO
YES
S16
HAS USER CHOSEN IMAGE ADJUSTMENT?
NO
YES
S19
HAS USER CHOSEN CANCELLATION OF PRINTING?
NO
YES
END
S17
PERFORM IMAGE ADJUSTMENT
S20
START PRINTING
RECALCULATE COVERAGES AND DETERMINE CONTINUOUSLY PRINTABLE DISTANCE
S18
S21
HAS PRINTING FINISHED?
NO
YES
S22
HAS PREDETERMINED TIME PASSED SINCE START OF PRINTING?
NO
YES
S23
ARE ACTUAL COVERAGES AS ESTIMATED?
YES
NO
S24
STOP PRINTING
END

IMAGE FORMING APPARATUS

BACKGROUND

1. Technological Field

The present disclosure relates to an image forming apparatus.

2. Description of the Related Art

An image forming apparatus that develops, with toner, electrostatic latent images formed on an image holder(s) and transfers the images onto paper is widely used. If such an image forming apparatus continuously prints images having low coverage, toner in a developing device(s) stays long therein and is stirred for a long time without being used for image forming. This causes toner particles to rub against other toner particles or carrier particles, and consequently deteriorates toner and decreases the electric charge amount.

When forming an image(s) having low coverage on each sheet of cut paper (sheet paper), the image forming apparatus prevents toner from deteriorating by forming a predetermined image pattern on an intermediate transfer belt between sheets of the paper at the timing when no image is formed, thereby ejecting toner. When using continuous paper, however, the image forming apparatus cannot eject toner due to no region between images for forming the image pattern. Thus, if an image forming apparatus continuously prints images having low coverage for a long distance without ejecting toner, toner in a developing device(s) is excessively deteriorated, and problems such as image fogging or toner scattering occurs on the printed images.

To deal with such problems, for example, there is disclosed in Japanese Patent No. 5741656 an image forming apparatus that forms images on the basis of image information in a predetermined image region of continuous paper, and at the same time, in predetermined side regions outside the image region of the continuous paper, forms predetermined image patterns that provide, together with the images formed on the basis of the image information, a toner ejection amount greater than or equal to a predetermined threshold. Furthermore, there is proposed a technology of forming image patterns for ejecting toner in predetermined side regions outside an image region of continuous paper when a distance of images printed on the continuous paper reaches or exceeds a predetermined distance.

According to Japanese Patent No. 5741656, however, because the image patterns are formed even if images having low coverage are formed for a short distance that does not badly affect or deteriorate toner in the developing device(s), toner is wastefully consumed. Furthermore, according to the technology of forming image patterns for ejecting toner when a distance of images printed is longer than or equal to a predetermined distance, because on the basis of the distance, the image patterns are formed even if images having high coverage that does not require additional ejection of toner are formed, toner is wastefully consumed. Furthermore, because the image patterns are formed in the side regions outside the image region of the continuous paper, the printable regions (image region) for users becomes narrow.

As a technology of ejecting deteriorated toner, there is a technology of stopping a job and forming an image pattern for ejecting toner on an intermediate transfer belt or the like when toner needs to be ejected. This technology can reduce wasteful consumption of toner, and also does not narrow the printable regions. However, because the job is interrupted, waste paper having a length at least between a transfer point (first transfer) and a fixing point is generated. Although users are required to remove such waste paper, they cannot grasp the distance of printing that makes a job stop and waste paper be generated. This is not user-friendly.

SUMMARY

Objects of the present disclosure include providing an image forming apparatus that allows a user(s) to grasp a distance for which the image forming apparatus can continuously print images on continuous paper without forming an image pattern for ejecting toner.

In order to achieve at least one of the abovementioned objects, according to an aspect of the present invention, there is provided an image forming apparatus including: an image former that prints a first image on continuous paper by: forming an electrostatic latent image on an image holder based on image information of a job; developing the electrostatic latent image with toner, thereby forming a toner image on the image holder; and transferring the toner image onto the continuous paper; an informing unit; and a hardware processor that: based on the image information of the job, calculates a coverage of the first image to be printed on the continuous paper; based on the calculated coverage, determines a continuously printable distance on the continuous paper; and causes the informing unit to inform a user of the continuously printable distance before the image former starts the printing.

BRIEF DESCRIPTION OF THE DRAWINGS

The objects, advantages, and features provided by one or more embodiments of the present invention will become more fully understood from the detailed description given hereinbelow and the appended drawings that are given by way of illustration only, and thus are not intended as a definition of the limits of the present invention, wherein:

FIG. 4 shows a flowchart of the continuous printing control process that is performed by the controller in FIG. 2;

DETAILED DESCRIPTION OF EMBODIMENTS

Hereinafter, one or more embodiments of the present invention will be described with reference to the drawings. However, the scope of the present invention is not limited to the disclosed embodiments.

Figure 1:
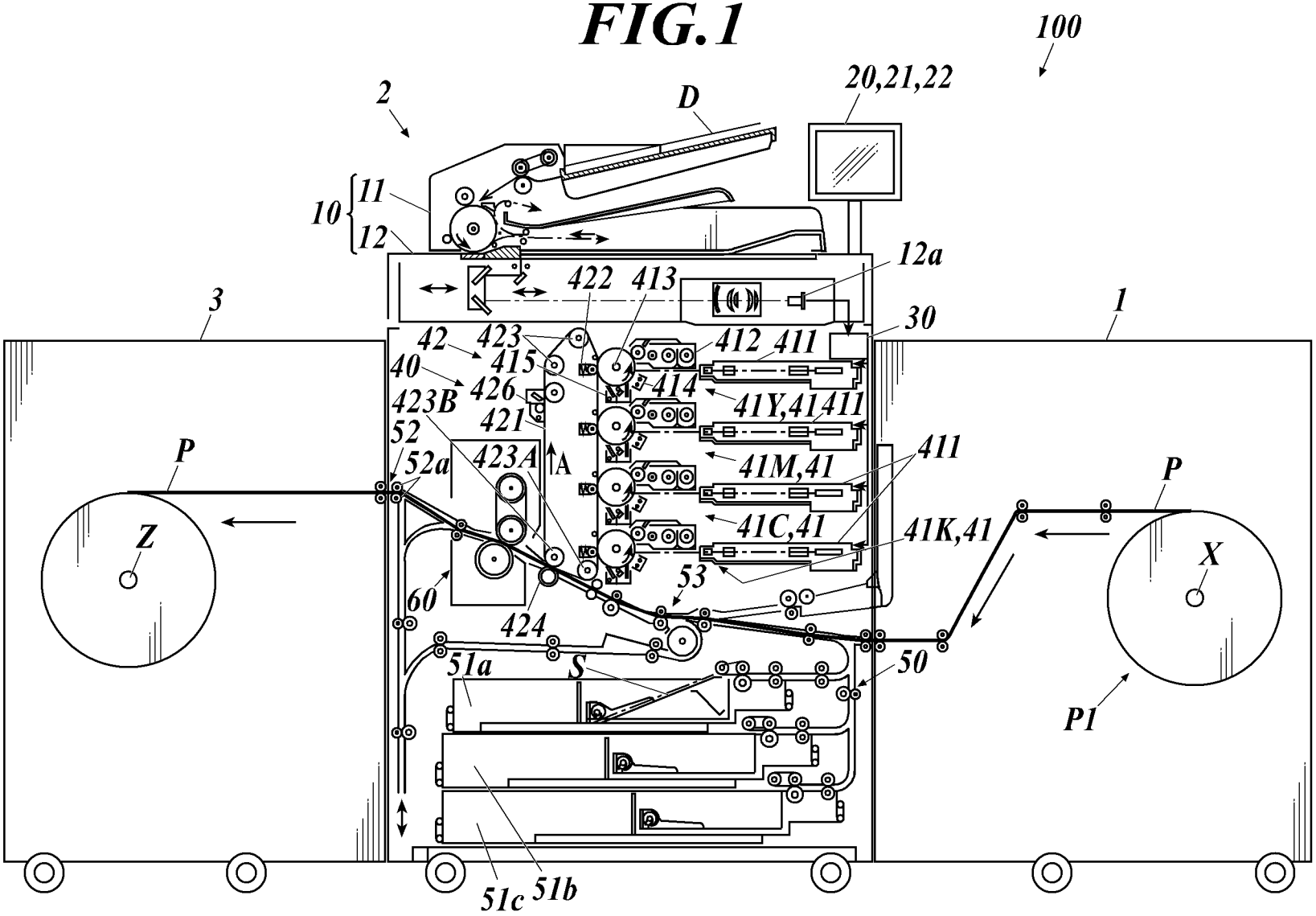
FIG. 1 shows an example of an overall configuration of an image forming apparatus according to an embodiment(s)
Figure 2:
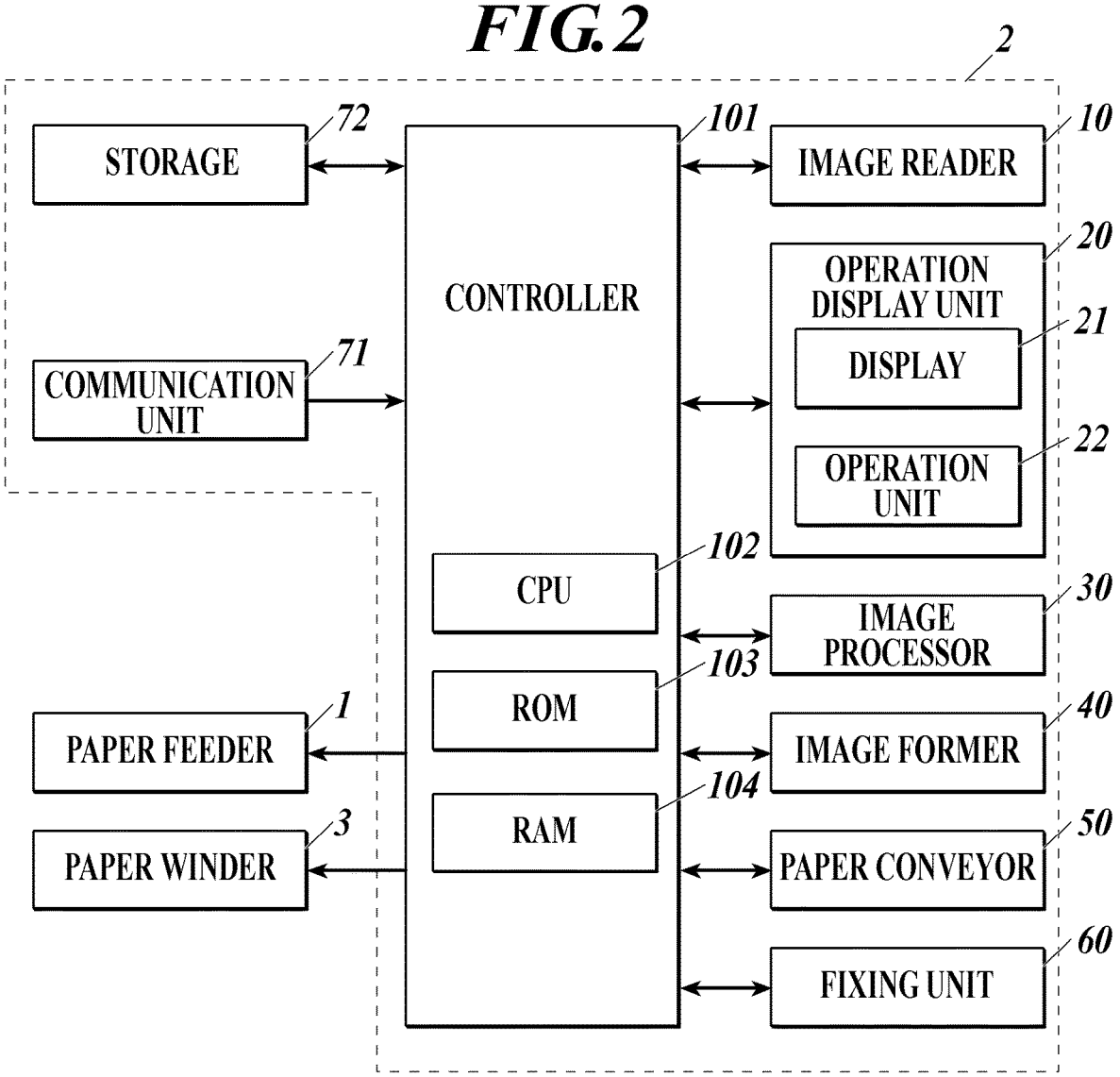
FIG. 2 shows main parts of a control system of the image forming apparatus in FIG. 1.

FIG. 1 shows an example of an overall configuration of an image forming apparatus 100 according to an embodiment(s). FIG. 2 shows main parts of a control system of a main body 2 of the image forming apparatus 100. The image forming apparatus 100 uses rolled continuous paper (hereinafter called paper P) represented by a thick line in FIG. 1 or sheet paper (hereinafter called paper S), and forms images on the paper P or the paper S.

As shown in FIG. 1, the image forming apparatus 100 includes a paper feeder 1, the main body 2, and a paper winder 3 that are arranged in this order from the upstream side along a conveying direction of the paper P (paper conveying direction) and joined. The paper feeder 1 and the paper winder 3 are used when the image forming apparatus 100 forms images on the paper P (i.e. not the paper S).

The paper feeder 1 feeds the paper P to the main body 2. As shown in FIG. 1, the paper feeder 1 houses, in its casing, a rotatable roll P1 configured such that the paper P is rolled around a supporting shaft X. The paper feeder 1 conveys the paper P rolled around the supporting shaft X to the main body 2 at a constant speed via pairs of conveying rollers including a pair of unwinding rollers and a pair of paper feeding rollers. The paper feeding operation of the paper feeder 1 is controlled by a controller 101 provided in the main body 2.

The main body 2 is an electrophotographic color image forming apparatus using the intermediate transfer system. That is, the main body 2 transfers, as the first transfer, toner images of respective colors of Y (yellow), M (magenta), C (cyan), and K (Bk: black) formed on respective photoconductive drums 413 as image holders onto an intermediate transfer belt 421 in such a way as to superpose the toner images on top of one another, thereby forming a YMCK toner image, on the intermediate transfer belt 421; and transfers, as the second transfer, the YMCK toner image on the intermediate transfer belt 421 onto the paper P fed from the paper feeder 1 or the paper S fed from a paper feeding tray unit 51*a*, 51*b*, or 51*c*. Thus, the main body 2 forms images on the paper P or the paper S.

As shown in FIG. 2, the main body 2 includes an image reader 10, an operation display unit 20, an imager processor 30, an image former 40, a paper conveyor 50, a fixing unit 60, a communication unit 71, a storage 72, and the controller 101.

The controller 101 includes a central processing unit (CPU) 102, a read only memory (ROM) 103, and a random access memory (RAM) 104. The CPU 102 reads out programs for desired processes from the ROM 103, loads them into the RAM 104, and, in cooperation with the loaded programs, integrally controls operation of each part of the main body 2, the paper feeder 1, and the paper winder 3. At the time, the controller 101 refers to various data stored in the storage 72. The storage 72 includes, for example, a nonvolatile semiconductor memory (so-called flash memory) and/or a hard disk drive.

The controller 101 sends/receives various data, via the communication unit 71, to/from external apparatuses (e.g. personal computers) that connect to a communication network, such as a local area network (LAN) or a wide area network (WAN). For example, the controller 101 receives jobs (job setting information and image data (image information)) sent from the external apparatuses. On the basis of the image data of the jobs, the controller 101 causes the image former 40 to print images on the paper P or the paper S. The communication unit 71 includes a communication control card, such as a LAN card. The controller 101 also causes the image former 40 to print images on the paper P or the paper S on the basis of image data read by the image reader 10.

The image reader 10 includes an auto document feeder (ADF) 11 and a document image scanning device (scanner) 12.

The ADF 11 conveys, with a conveyance mechanism, documents D placed on a document tray to the scanner 12. The ADF 11 allows the scanner 12 to continuously and ceaselessly read images on both sides of a large number of documents D placed on the document tray.

The scanner 12 optically scans each document conveyed onto a platen glass from the ADF 11 or document placed on the platen glass, and forms, on a light receiving face of a charge coupled device (CCD) sensor 12*a*, an image of the reflected light from the document, thereby reading the image on the document. The image reader 10 generates image data on the basis of the reading result by the scanner 12. The image processor 30 performs predetermined image processing on the image data.

The operation display unit 20 includes, for example, a liquid crystal display (LCD) provided with a touchscreen, and functions as a display 21 and an operation unit 22.

The display 21 is an example of an informing unit, and displays, for example, various operation screens, image conditions, and operation statuses of functions in accordance with display control signals input from the controller 101.

The operation unit 22 includes the touchscreen and various operation keys/buttons including a numeric keypad and a start button. The operation unit 22 receives various input operations made by a user(s), and outputs operation signals to the controller 101.

The image processor 30 includes, for example, a rasterization section, a color conversion section, a gradation correction section, and a halftoning section, and performs various kinds of image processing on image data in accordance with the control of the controller 101.

The image former 40 includes: image forming units 41Y, 41M, 41C, and 41K to form images with toner of the respective colors, namely color components Y, M, C, and K, on the basis of the processed image data; and an intermediate transfer unit 42.

The image forming units 41Y, 41C, 41M, and 41K for the respective color components Y, M, C, and K have the same configuration (i.e. the same parts). For convenience of illustration and explanation, the parts common to the image forming units 41Y, 41C, 41M, and 41K are indicated by the same reference numerals. If any of the parts need to be specified as a part of the image forming unit 41Y, 41C, 41M, or 41K, "Y", "M", "C", or "K" is added to its reference numeral. In FIG. 1, only the parts of the image forming unit 41Y, which is for the color component Y, have reference numerals, and the reference numerals of the parts of the other image forming units 41M, 41C, and 41K are omitted.

Each image forming unit 41 includes an exposure device 411, a developing device 412, a photoconductive drum 413, a charger 414, and a drum cleaner 415.

The photoconductive drum 413 consists of, for example, a negatively chargeable organic photoconductor (OPC) in which an under coat layer (UCL), a charge generation layer (CGL), and a charge transport layer (CTL) are laminated in order on the peripheral surface of an electroconductive cylindrical aluminum body (aluminum tube). The CGL consists of an organic semiconductor made up of a resin binder (e.g. polycarbonate resin) and a charge generation material (e.g. phthalocyanine pigment) dispersed in the resin binder, and generates pairs of positive charges and negative charges when exposed by the exposure device 411. The CTL is made up of a resin binder (e.g. polycarbonate resin) and a hole transport material (electron-donating nitrogen-containing compounds) dispersed in the resin binder, and transfers the positive charges generated at the CGL to the surface of the CTL.

The charger 414 negatively and uniformly charges the surface of the photoconductive drum 413. The exposure device 411 is, for example, a semiconductor laser, and emits laser light corresponding to an image(s) of its color component onto the photoconductive drum 413. The positive charges generated at the CGL of the photoconductive drum 413 by the exposure are transferred to the surface of the CTL, thereby neutralizing the negative charges of the surface of the photoconductive drum 413. On the surface of the photoconductive drum 413, an electrostatic latent image(s) of its color component is formed by the electric potential difference between the exposed regions and their surroundings.

The developing device 412 uses, for example, a two-component developer. The developing device 412 makes toner of its color component adhere to the surface of the photoconductive drum 413 with a developing roller as a developer holder, thereby visualizing the electrostatic latent image and consequently forming a toner image.

The drum cleaner 415 includes a drum cleaning blade that slidingly contacts the surface of the photoconductive drum 413, and a lubricant applicator that applies a lubricant onto the surface of the photoconductive drum 413. The drum cleaner 415 removes the residual toner remaining on the surface of the photoconductive drum 413 after the first transfer.

The intermediate transfer unit 42 includes an intermediate transfer belt 421 as an image holder, first transfer rollers 422, supporting rollers 423, a second transfer roller 424, and a belt cleaner 426.

The intermediate transfer belt 421 is an endless belt stretched around the supporting rollers 423 to be a loop. At least one of the supporting rollers 423 is a driving roller, and the others are driven rollers. For example, the supporting roller 423A, which is provided on the downstream side of the first transfer roller 422K in the belt running direction, is preferable as the driving roller. This makes it easy to keep the running speed of the intermediate transfer belt 421 at first transfer points (i.e. first transfer nip points described below) uniform. Rotation of the driving roller 423A makes the intermediate transfer belt 421 run in the direction indicated by an arrow A at a constant speed.

The first transfer rollers 422 are arranged on the inner circumference side of the intermediate transfer belt 421 in such a way as to face the photoconductive drums 413 for the respective color components. The first transfer rollers 422 are pressed to contact their respective photoconductive drums 413 with the intermediate transfer belt 421 in between, thereby forming the abovementioned first transfer nip points for transferring the toner images from the photoconductive drums 413 to the intermediate transfer belt 421.

The second transfer roller 424 is arranged on the outer circumference side of the intermediate transfer belt 421 in such a way as to face the back-up roller 423B, which is provided on the downstream side of the driving roller 423A in the belt running direction. The second transfer roller 424 is pressed to contact the back-up roller 423B with the intermediate transfer belt 421 in between, thereby forming a second transfer nip point for transferring the YMCK toner image from the intermediate transfer belt 421 to the paper P or the paper S. Instead of the second transfer roller 424, a belt-type second transfer unit configured such that a second transfer belt is stretched around supporting rollers that includes a second transfer roller may be used.

When the intermediate transfer belt 421 passes through the first transfer nip points, the toner images on the respective photoconductive drums 413 are sequentially transferred as the first transfer onto the intermediate transfer belt 421 in such a way as to be superposed on top of one another on the intermediate transfer belt 421. More specifically, a first transfer bias is impressed on the first transfer rollers 422, so that charges having reverse polarity to that of the toner are given to the inner side of the intermediate transfer belt 421, namely the side that abuts the first transfer rollers 422. Thus, the toner images of the respective colors are electrostatically transferred onto the intermediate transfer belt 421.

When the paper P or the paper S passes through the second transfer nip point, the YMCK toner image on the intermediate transfer belt 421 is transferred as the second transfer onto the paper P or the paper S. More specifically, a second transfer bias is impressed on the second transfer roller 424, so that charges having reverse polarity to that of the toner are given to the back side of the paper P or the paper S, namely the side that abuts the second transfer roller 424. Thus, the YMCK toner image is electrostatically transferred onto the paper P or the paper S. The paper P or the paper S with the YMCK toner image transferred thereto is conveyed to the fixing unit 60.

The belt cleaner 426 removes the residual toner remaining on the surface of the intermediate transfer belt 421 after the second transfer.

The fixing unit 60 heats and presses, at a fixing nip point, the paper P or the paper S that has been conveyed with the YMCK toner image secondly transferred thereto, thereby fixing the YMCK toner image to the paper P or the paper S.

The paper conveyor 50 includes the paper feeding tray units 51*a*, 51*b*, and 51*c*, a paper ejector 52, and a conveyance path unit 53. The paper feeding tray units 51*a*, 51*b*, and 51*c* house sheets of the paper S (standardized paper or special paper) by predetermined type, the sheets being sorted according to, for example, the basis weight and/or the size. The conveyance path unit 53 has pairs of conveying rollers.

The sheets of the paper S stored in the paper feeding tray units 51*a*, 51*b*, and 51*c* are sent off one by one from the top and conveyed to the image former 40 by the conveyance path unit 53. In the image former 40, the YMCK toner image on the intermediate transfer belt 421 is transferred onto one side of a sheet of the paper S as the second transfer, and in the fixing device 60, the sheet is subjected to fixing and then ejected. Meanwhile, the paper P fed to the main body 2 from the paper feeder 1 is conveyed to the image former 40 by the conveyance path unit 53 while being kept under tension thereby. In the image former 40, the YMCK toner image on the intermediate transfer belt 421 is transferred onto one side of the paper P as the second transfer, and in the fixing device 60, the paper P is subjected to fixing. The image-formed paper P is conveyed to the paper winder 3 by the paper ejector 52 that includes a pair of conveying rollers (a pair of paper ejecting rollers) 52*a*.

The paper winder 3 winds up the paper P conveyed from the main body 2. The paper winder 3 houses, in its casing, the paper P rolled around a supporting shaft Z. For that, the paper winder 3 winds the paper P around the supporting shaft Z at a constant speed, the paper P having been conveyed from the main body 2 and wound up via pairs of conveying rollers including the pair of paper ejecting rollers 52*a* and a pair of winding rollers. The paper winding operation of the paper winder 3 is controlled by the controller 101 provided in the main body 2.

Next, operation of the main body 2 to print images on the paper P (continuous paper) is described.

Figure 3:
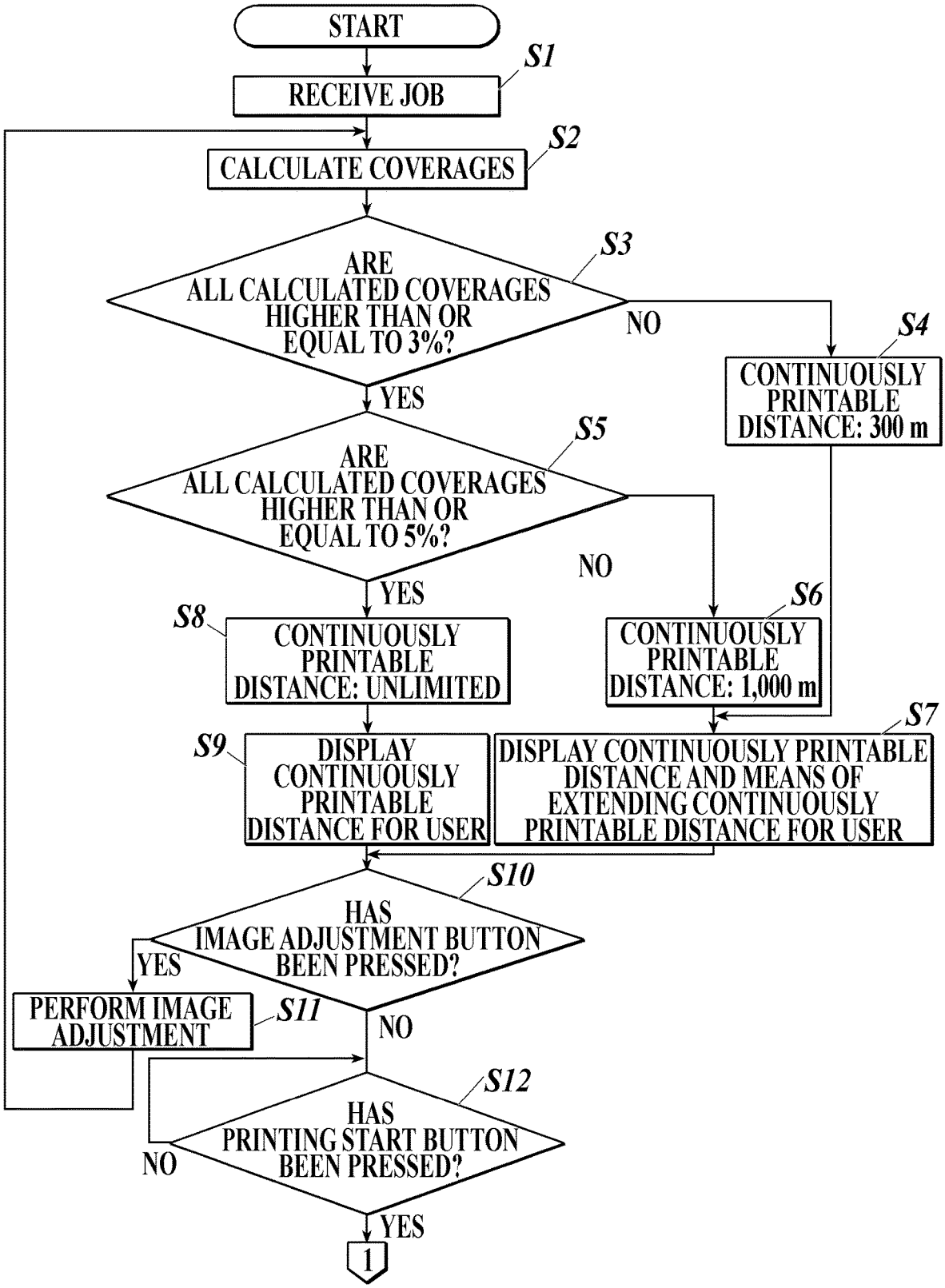
FIG. 3 shows a flowchart of a continuous printing control process that is performed by a controller in FIG. 2.

FIG. 3 and FIG. 4 are flowcharts showing a continuous printing control process that is performed by the controller 101 to print images on the paper P. The continuous printing control process is performed by the CPU 102 of the controller 101 in cooperation with the program(s) stored in the ROM 103.

When the communication unit 71 receives a job from an external apparatus, the controller 101 causes the storage 72 to store the received job (job setting information and image data) (Step S1). The job setting information includes a paper width, a paper type, a paper thickness, and the number of copies (a set number of copies).

Next, the controller 101 calculates coverages of the respective colors of Y, M, C, and K on the basis of the image data of the job (Step S2).

In general, to print images on continuous paper, a process to print an image in a predetermined-sized printable region of the continuous paper is repeated. In printable regions of continuous paper, the same image may be printed repeatedly, or different images may be printed. At Step S2, for each color, the controller 101 calculates coverages of images (the same image or different images) to be printed in the respective printable regions of the paper P (coverage=area of image to be printed÷area of printable region×100(%)) on the basis of the image data of the job, and calculates the average value of the calculated coverages as a coverage of the whole job.

Next, the controller 101 determines whether or not all the calculated coverages of the respective colors are higher than or equal to 3% (Step S3).

If the controller 101 determines that not all the calculated coverages of the respective colors are higher than or equal to 3% (i.e. at least one of the calculated coverages is lower than 3%) (Step S3: NO), the controller 101 determines the continuously printable distance to be 300 meters (Step S4), causes the display 21 to display a job setting screen 211 including the continuously printable distance and means of extending the continuously printable distance (i.e. how to extend the continuously printable distance) (Step S7), and then proceeds to Step S10.

If the controller 101 determines that all the calculated coverages of the respective colors are higher than or equal to 3% (Step S3: YES), the controller 101 determines whether or not all the calculated coverages of the respective colors are higher than or equal to 5% (Step S5).

If the controller 101 determines that not all the calculated coverages of the respective colors are higher than or equal to 5% (i.e. at least one of the calculated coverages is lower than 5%) (Step S5: NO), the controller 101 determines the continuously printable distance to be 1,000 meters (Step S6), causes the display 21 to display the job setting screen 211 including the continuously printable distance and means of extending the continuously printable distance (Step S7), and then proceeds to Step S10.

If the controller 101 determines that all the calculated coverages of the respective colors are higher than or equal to 5% (Step S5: YES), the controller 101 determines the continuously printable distance to be unlimited (Step S8), causes the display 21 to display the job setting screen 211 including the continuously printable distance (unlimited) (Step S9), and then proceeds to Step S10.

If an electrophotographic image forming apparatus continuously prints toner images having low coverage, toner in a developing device(s) stays long therein and is stirred for a long time without being used for image forming. This causes toner particles to rub against other toner particles or carrier particles, and consequently deteriorates toner and decreases the electric charge amount. When forming an image(s) having low coverage on each sheet of cut paper (sheet paper), the image forming apparatus prevents toner from deteriorating by forming a predetermined image pattern on an intermediate transfer belt between sheets of the paper at the timing when no image is formed, thereby ejecting toner. When using continuous paper, however, the image forming apparatus cannot form the image pattern between images. To deal with this problem, there is a conventional technology of forming image patterns (equivalent to a second image described below) for ejecting toner in predetermined side regions outside an image region of continuous paper. In this technology, however, because the image patterns are formed even if the distance of printing does not badly affect or deteriorate toner, or images have high coverage, problems such as wasteful consumption of toner and narrowing of the printable regions (image region) arise. Meanwhile, there is a technology of stopping a job and forming an image pattern for ejecting toner on an intermediate transfer belt or the like when toner needs to be ejected. This technology can prevent deterioration of toner without wasteful consumption of toner. However, users cannot grasp, for example, up to what distance continuous printing is available or when a job stops and waste paper is generated. This is not user-friendly (i.e. low usability).

In this embodiment, by performing the abovementioned Steps S2 to S9, the controller 101 calculates the coverages on the basis of the image data of the job; on the basis of the calculated coverages, determines the continuously printable distance, for which the image forming apparatus 100 can continuously print images on the paper P without forming an image pattern for ejecting toner (i.e. without causing deterioration of toner); and causes the display 21 to display the continuously printable distance. This allows the user to grasp up to what distance continuous printing is available, namely when the job stops and waste paper is generated. Thus, the usability is enhanced. The correlations between the coverages and the continuously printable distance used at Steps S3 to S9 are obtained beforehand by experiment.

Figure 5:
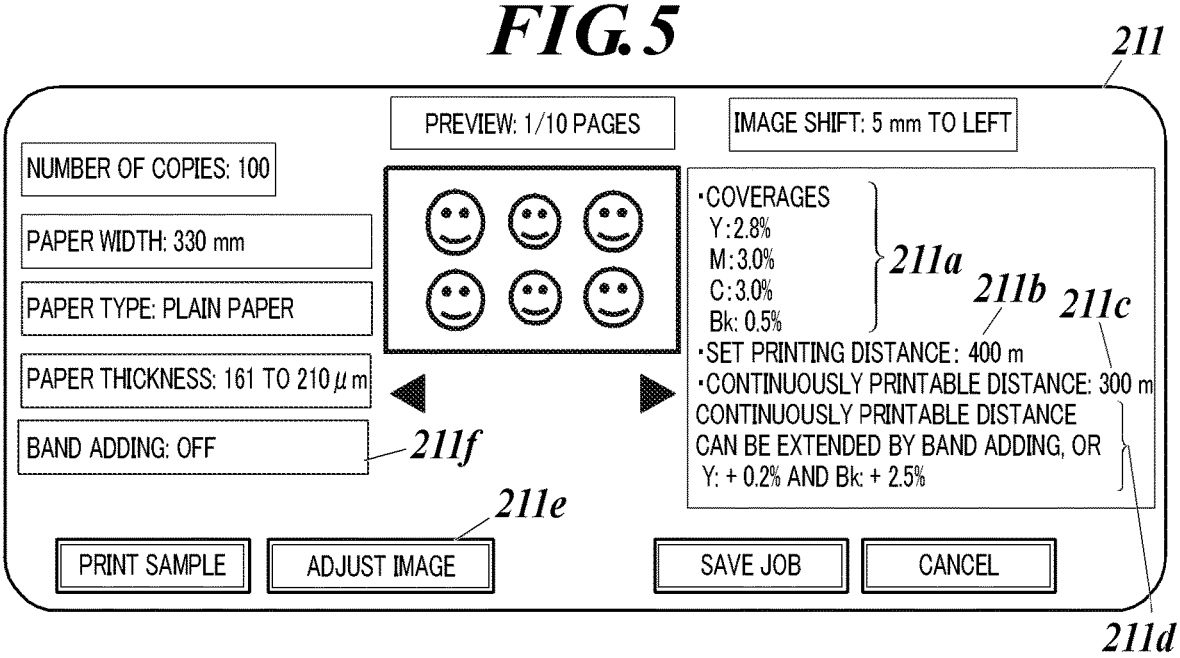
FIG. 5 shows an example of a job setting screen.

FIG. 5 shows an example of the job setting screen 211 that is displayed by/on the display 21 at Steps S7 and S9. As shown in FIG. 5, the job setting screen 211 is a screen showing the job setting information (the number of copies, paper width, paper type, paper thickness, etc.) and a preview image. When the continuously printable distance is determined, respective colors' coverages 211*a*, a set printing distance (printing distance for the job determined on the basis of the image data and the number of copies included in the job) 211*b*, and a continuously printable distance 211*c* are displayed on the job setting screen 211. If the continuously printable distance is limited and is shorter than the set printing distance, means of extending the continuously printable distance 211*d*, an image adjustment ("adjust image") button 211*e* for making an instruction to perform image adjustment, and a band adding button 211*f* for making an instruction to additionally print a band(s) (second image) for ejecting toner in the edge region(s) of the paper P are also displayed on the job setting screen 211.

By referring to the continuously printable distance 211*c*, the user can grasp up to what distance the image forming apparatus 100 can continuously print images without forming an image pattern for ejecting toner, namely when the job stops and waste paper is generated. By referring to the means of extending the continuously printable distance 211*d*, the user can learn how to extend the continuously printable distance. By referring to the coverages 211*a*, the user can learn how high or low the coverages of the job to be printed are.

With the image adjustment button 211*e* provided on the job setting screen 211, the user can immediately perform image adjustment, thereby changing the continuously printable distance, if the continuously printable distance is not enough. With the band adding button 211*f* provided on the job setting screen 211, the user can make an instruction to form/print the second image if the user wishes not to stop the job even if a large amount of toner is consumed.

If the controller 101 determines that the image adjustment button 211*e* has been pressed with the operation unit 22 (Step S10: YES), the controller 101 causes the display 21 to display an image adjustment screen (not illustrated) and adjusts the image data of the job in response to the user's operation(s) thereon (Step S11), and then returns to Step S2. Examples of the image adjustment include tone curve adjustment and density change. Performing the image adjustment to increase the coverage(s) of a color(s) specified in the means of extending the continuously printable distance 211*d* can extend the continuously printable distance.

When the image adjustment button 211*e* is pressed, a pop-up screen or the like may be displayed on the display 21 for the user to choose whether to perform the image adjustment on the image adjustment screen or adjust and resend the image data of the job. If the user chooses to adjust and resend the image data of the job, he/she can adjust the image data with an external apparatus and resend the adjusted image data therefrom. When receiving the adjusted image data resent from the external apparatus, the controller 101 replaces the image data of the job with the adjusted image data, and then returns to Step S2.

If the controller 101 determines that the printing start button (start button) has been pressed (Step S12: YES), the controller 101 determines whether or not "continuously printable distance<set printing distance" holds (Step S13).

If the controller 101 determines that "continuously printable distance<set printing distance" does not hold (Step S13: NO), the controller 101 proceeds to Step S20.

If the controller 101 determines that "continuously printable distance<set printing distance" holds (Step S13: YES), the controller 101 causes the display 21 to display a printing choice screen 212 (Step S14).

Figure 6:
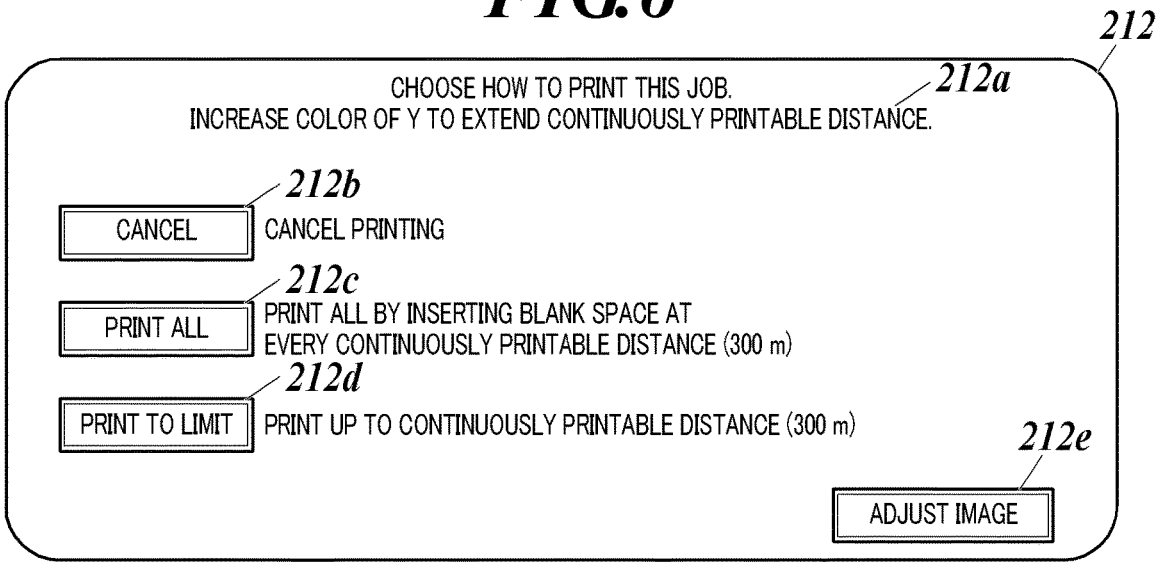
FIG. 6 shows an example of a printing choice screen.

FIG. 6 shows an example of the printing choice screen 212. The printing choice screen 212 is a screen for the user to choose whether or not to perform printing, and to choose a printing method if the user chooses to perform printing. As shown in FIG. 6, the printing choice screen 212 has a message 212*a* indicating means of extending the continuously printable distance, such as "Increase color of Y to extend continuously printable distance.", a cancellation ("cancel") button 212*b*, a print-all ("print all") button 212*c*, a print-to-limit ("print to limit") button 212*d*, and an image adjustment ("adjust image") button 212*e*. The cancellation button 212*b* is a button to choose cancellation of printing. The print-all button 212*c* is a button to choose to print all images of the job by inserting a blank space (i.e. stopping the job and ejecting toner) at every continuously printable distance ("(m)"). The print-to-limit button 212***d* is a button to choose to print images of the job up to the continuously printable distance ("(m)"). The image adjustment button 212***e* is a button to make an instruction to perform image adjustment. The image adjustment button 212*e* has the same functions as the image adjustment button 211*e* on the job setting screen 211. Performing the image adjustment to increase the coverage(s) of a color(s) specified in the message 212*a* can extend the continuously printable distance.

With the cancellation button 212*b*, the print-all button 212*c*, and the print-to-limit button 212*d* provided on the printing choice screen 212, the user can choose whether or not to print the job even after making an instruction to start printing the job. If the user chooses to print the job, the user can choose whether to print images of the job up to the continuously printable distance or print all images of the job by inserting a blank space at every continuously printable distance.

By referring to the message 212*a* indicating means of extending the continuously printable distance displayed on the printing choice screen 212, the user can learn how to extend the continuously printable distance. With the image adjustment button 212*e* provided on the printing choice screen 212, the user can immediately perform image adjustment, thereby changing the continuously printable distance, if the continuously printable distance is not enough.

In this embodiment, as the continuously printable distance ("(m)") in the explanations of the print-all button 212***c* and the print-to-limit button 212*d* on the printing choice screen 212, "300 m" is displayed in the case where the set printing distance is longer than 300 meters, and at least one of the coverages of the respective colors is lower than 3%; and "1,000 m" is displayed in the case where the set printing distance is longer than 1,000 meters, and all the coverages of the respective colors are higher than or equal to 3% but at least one of them is lower than 5%.

The printing choice screen 212 may display the coverages as with the job setting screen 211. This allows the user to learn how high or low the coverages of the job to be printed are.

The controller 101 determines whether or not printing has been chosen (i.e. the print-all button 212*c* or the print-to-limit button 212*d* has been pressed) on the printing choice screen 212 with the operation unit 22 (Step S15).

If the controller 101 determines that printing has not been chosen with the operation unit 22 (Step S15: NO), the controller 101 determines whether or not the image adjustment button 212*e* has been pressed with the operation unit 22 (Step S16).

If the controller 101 determines that the image adjustment button 212*e* has been pressed with the operation unit 22 (Step S16: YES), the controller 101 causes the display 21 to display an image adjustment screen (not illustrated) and adjusts the image data of the job in response to the user's operation(s) thereon (Step S17), recalculates the coverages and determines (changes) the continuously printable distance (Step S18), and then returns to Step S13.

If the controller 101 determines that cancellation of printing has been chosen (i.e. the cancellation button 212*b* has been pressed) with the operation unit 22 (Step S15: NO, Step S16: NO, Step S19: YES), the controller 101 ends the continuous printing control process.

If the controller 101 determines that printing has been chosen with the operation unit 22 (Step S15: YES), the controller 101 proceeds to Step S20.

At Step S20, the controller 101 controls the paper feeder 1, the image former 40, the paper conveyor 50, the fixing unit 60, the paper winder 3, and so forth (printing-related parts) to cause them to start printing images on the paper P on the basis of the image data of the job (Step S20).

If the band adding button 211*f* has been pressed on the job setting screen 211, the controller 101 causes the printing-related parts to print, along the images based on the job, a band(s) (second image) for ejecting toner in the edge region(s) of the paper P.

If the "print-to-limit" has been chosen on the printing choice screen 212, the controller 101 causes the printing-related parts to print images up to the continuously printable distance (i.e. print images until the real-time printing distance in the job reaches the continuously printable distance), and end the printing (i.e. end the printing when the real-time printing distance reaches the continuously printable distance).

If the "print-all" has been chosen on the print choice screen 212, at every continuously printable distance, the controller 101 causes the paper conveyor 50 to stop conveying the paper P, and causes the image former 40 to form an image pattern for ejecting toner on the intermediate transfer belt 421, thereby ejecting toner staying in the developing devices 412.

After causing the printing-related parts to start printing images, the controller 101 determines whether or not the printing based on the job has finished (Step S21).

If the controller 101 determines that the printing based on the job has not finished yet (Step S21: NO), the controller 101 determines whether or not a predetermined time has passed since the start of the printing (Step S22). If the controller 101 determines that the predetermined time has not passed since the start of the printing yet (Step S22: NO), the controller 101 returns to Step S21.

If the controller 101 determines that the predetermined time has passed since the start of the printing (Step S22: YES), the controller 101 calculates, for each color, the total area of the images having been printed during the predetermined time since the start of the printing; calculates, for each color, the actual coverage (coverage of actually-printed images) on the basis of the calculated total area of the images; and determines whether or not the actual coverages of the respective colors are as estimated, namely agree with the coverages calculated at Step S2 or S18 (Step S23).

For example, at Step S23, using the time required for the real-time printing distance to be 300 meters as the predetermined time for calculating the actual coverages of the respective colors, the controller 101 calculates, for each color, the total area of the images having been printed during the predetermined time since the start of the printing and the total area of the printable regions where the images have been printed, and calculates, for each color, the actual coverage by the following formula: actual coverage=calculated total area of printed images÷calculated total area of printable regions×100(%). In the case where all the coverages of the respective colors calculated at Step S2 or S18 are higher than or equal to 3%, if all the actual coverages of the respective colors are higher than or equal to 3%, the controller 101 determines at Step S23 that the actual coverages are as estimated; whereas if at least one of the actual coverages of the respective colors is lower than 3%, the controller 101 determines at Step S23 that the actual coverages are not as estimated. If at least one of the coverages of the respective colors calculated at Step S2 or S18 is lower than 3%, there is no case where images are continuously printed over 300 meters, and hence Step S23 where the controller 101 makes the above-described determination using the time required for the real-time printing distance to be 300 meters as the predetermined time for calculating the actual coverages of the respective colors is unnecessary, and the controller 101 returns to Step S21.

As another example, using the time required for the real-time printing distance to be 1,000 meters as the predetermined time for calculating the actual coverages of the respective colors, the controller 101 calculates, for each color, the total area of the images having been printed during the predetermined time since the start of the printing and the total area of the printable regions where the images are printed, and calculates, for each color, the actual coverage by the following formula: actual coverage=calculated total area of printed images÷calculated total area of printable regions×100(%). In the case where all the coverages of the respective colors calculated at Step S2 or S18 are higher than or equal to 5%, if all the actual coverages of the respective colors are higher than or equal to 5%, the controller 101 determines at Step S23 that the actual coverages are as estimated; whereas if at least one of the actual coverages of the respective colors is lower than 5%, the controller 101 determines at Step S23 that the actual coverages are not as estimated. If at least one of the coverages of the respective colors calculated at Step S2 or S18 is lower than 5%, there is no case where images are continuously printed over 1,000 meters, and hence Step S23 where the controller 101 makes the above-described determination using the time required for the real-time printing distance to be 1,000 meters as the predetermined time for calculating the actual coverages of the respective colors is unnecessary, and the controller 101 returns to Step S21.

If the controller 101 determines that the actual coverages are as estimated (Step S23: YES), the controller 101 returns to Step S21.

If the controller 101 determines that the actual coverages are not as estimated (Step S23: NO), the controller 101 causes the printing-related parts to stop printing images and outputs an error (Step S24), and ends the continuous printing control process. The controller 101 causes the printing-related parts to stop the printing if the actual coverage(s) is lower than the estimated coverage(s) because image fogging or toner scattering may occur if the printing continues. The error may be output either by displaying an error indication on the display 21, or outputting an alarm or the like.

At Step S21, if the controller 101 determines that the printing based on the job has finished (Step S21: YES), the controller 101 ends the continuous printing control process.

In the continuous printing control process described above, the controller 101 calculates, for each color, the average value of the coverages of all the images included in the job as the coverage of the whole job, and determines the continuously printable distance by determining whether or not the calculated coverages of the respective colors are higher than or equal to a predetermined threshold value. This is, however, not a limitation. The controller 101 may determine the continuously printable distance, for example, on the basis of the total distance of images included in the job and having the coverages of the respective colors lower than a predetermined threshold value. For example, the controller 101 determines the continuously printable distance to be 300 meters if the total distance of images included in the job and having the coverages of the respective colors at least one of which is lower than 3% exceeds 300 meters; determines the continuously printable distance to be 1,000 meters if the total distance of images included in the job and having the coverages of the respective colors all of which are higher than or equal to 3% but at least one of which is lower than 5% exceeds 1,000 meters; and determines the continuously printable distance to be unlimited if the total distance of images included in the job and having the coverages of the respective colors all of which are higher than or equal to 5% is the set printing distance (distance for all the images of the job).

As described above, the controller 101 of the image forming apparatus 100 calculates, on the basis of image data of a job, a coverage(s) of a first image(s) to be printed on the paper P (continuous paper); on the basis of the calculated coverage, determines the continuously printable distance on the paper P; and causes the display 21 to display the determined continuously printable distance before the image former 40 starts the printing.

This allows the user to grasp the continuously printable distance, for which the image forming apparatus 100 can continuously print images on continuous paper without forming an image pattern for ejecting toner.

Preferably, the controller 101 adjusts the image data of the job; recalculates the coverage on the basis of the adjusted image data; and determines the continuously printable distance on the basis of the recalculated coverage. This allows the user to grasp the continuously printable distance reflecting image adjustment if the image adjustment is performed.

Preferably, the controller 101 calculates the total area of the first image(s) having been printed on the paper P during a predetermined time since the start of the printing by the image former 40; and on the basis of the calculated total area of the first image(s), determines (controls) whether or not to stop the printing being performed by the image former 40. Thus, the image forming apparatus 100 can immediately stop printing if the total area of the actually-printed images is not as estimated.

Preferably, if the printing distance for the job exceeds the continuously printable distance determined on the basis of the coverage calculated from the image data of the job, the controller 101 causes the display 21 to display, after the user makes an instruction to start the printing, on the printing choice screen 212, choices for the user to choose whether or not to perform the printing; and in accordance with a choosing operation made by the user between the choices, determines whether to start or cancel the printing. This allows the user to choose whether or not to print the job even after making an instruction to start printing the job if the printing distance for the job exceeds the continuously printable distance, which has been determined on the basis of the coverages calculated from the image data of the job.

Preferably, the controller 101 further causes the display 21 to display, on the printing choice screen 212, choices for the user to choose a printing method to perform the printing, the choices including a method of printing the first image(s) of the job up to the continuously printable distance and a method of printing all the first image(s) of the job by inserting a blank space at an interval of the continuously printable distance; and on the basis of the printing method chosen by the user for the job, causes the image former 40 to perform the printing. This allows the user to choose whether to print images of the job up to the continuously printable distance or print all images of the job by inserting a blank space at every continuously printable distance if the printing distance for the job exceeds the continuously printable distance, which has been determined on the basis of the coverage calculated from the image data of the job.

Preferably, the controller 101 further causes the display 21 to display, on the printing choice screen 212, a method of extending the continuously printable distance. This allows the user to know how to extend the continuously printable distance.

Preferably, the controller 101 further causes the display 21 to display, on the printing choice screen 212, the coverage of the image data of the job. This allows the user to learn how high or low the coverages of the job to be printed are.

Preferably, the controller 101 further causes the display 21 to display, on the printing choice screen 212, an image adjustment button for making an instruction to adjust the image data of the job; and if the image adjustment button is pressed with the operation unit 22, adjusts the image data of the job, thereby changing the continuously printable distance. This allows the user to immediately perform image adjustment, thereby changing the continuously printable distance, if the continuously printable distance is not enough.

Preferably, the controller 101 causes the display 21 to display, on the job setting screen 211, the continuously printable distance before the user makes an instruction to start the printing. This allows the user to grasp the continuously printable distance before making an instruction to start printing the job.

Preferably, the controller 101 further causes the display 21 to display, on the job setting screen 211, the method of extending the continuously printable distance. This allows the user to know how to extend the continuously printable distance.

Preferably, the controller 101 further causes the display 21 to display, on the job setting screen 211, the coverage of the image data of the job. This allows the user to learn how high or low the coverages of the job to be printed are.

Preferably, the controller 101 further causes the display 21 to display, on the job setting screen 211, an image adjustment button for making an instruction to adjust the image data of the job; and if the image adjustment button is pressed with the operation unit 22, adjusts the image data of the job, thereby changing the continuously printable distance. This allows the user to immediately perform image adjustment, thereby changing the continuously printable distance, if the continuously printable distance is not enough.

Preferably, if the printing distance for the job exceeds the continuously printable distance determined on the basis of the coverage calculated from the image data of the job, the controller 101 causes the display 21 to display a band adding button for making an instruction to print, on the paper P, a second image for ejecting toner in addition to the first image; and if the band adding button is pressed, the controller 101 causes the image former 40 to print the second image in the edge region(s) of the paper P when printing the first image on the paper P. Thus, if the user wishes not to stop the job although toner consumption increases (i.e. wishes not to generate waste paper), deterioration of toner can be avoided by printing, on the paper P, the second image for ejecting toner.

The embodiment described above is one of preferred examples of the image forming apparatus according to the present invention and not intended to limit the present invention.

For example, in the above embodiment, as the image forming apparatus 100, there is described, as an example, a color image forming apparatus that firstly transfers images formed on photoconductive drums onto an intermediate transfer belt, and secondly transfers the images on the intermediate transfer belt onto paper with a second transfer roller. The present invention is also applicable to a monochrome image forming apparatus that directly transfers images from a photoconductive drum onto paper with a transfer roller.

Furthermore, in the above description, although a ROM, a nonvolatile semiconductor memory, and a hard disk drive are disclosed as examples of a computer-readable storage medium storing the programs disclosed therein, the computer-readable storage medium is not limited to these. As the computer-readable storage medium, a portable storage medium, such as a CD-ROM, may also be used. Also, as a medium that provides data of the programs, which are disclosed herein, via a communication line, a carrier wave can be used.

Furthermore, in the above embodiment, although a display is cited as an example of the informing unit, the informing unit is not limited to one that delivers information to users by displaying the information, and hence may be one that delivers information to users with audio or the like.

The detailed configurations and detailed operations of the image forming apparatus can also be appropriately modified without departing from the scope of the present invention.

Although some embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-129647 filed on Jul. 9, 2018 is incorporated herein by reference in its entirety.

What is claimed is:

1. An image forming apparatus comprising:

an image former that prints a first image on continuous paper by: forming an electrostatic latent image on an image holder based on image information of a job; developing the electrostatic latent image with toner, thereby forming a toner image on the image holder; and transferring the toner image onto the continuous paper;

an informing unit; and a hardware processor that:

based on the image information of the job, calculates a coverage of the first image to be printed on the continuous paper;

based on the calculated coverage, determines a continuously printable distance on the continuous paper; and causes the informing unit to inform a user of the continuously printable distance before the image former starts the printing.

2. The image forming apparatus according to claim 1, wherein the hardware processor:

adjusts the image information of the job;

recalculates the coverage based on the adjusted image information; and determines the continuously printable distance based on the recalculated coverage.

3. The image forming apparatus according to claim 1, wherein the hardware processor:

calculates a total area of the first image having been printed on the continuous paper during a predetermined time since the start of the printing by the image former;

based on the calculated total area of the first image, determines whether or not to stop the printing being performed by the image former.

4. The image forming apparatus according to claim 1, wherein the hardware processor:

if a printing distance for the job exceeds the continuously printable distance calculated from the image information of the job, causes the informing unit to inform the user, after the user makes an instruction to start the printing, of choices for the user to choose whether or not to perform the printing; and in accordance with a choosing operation made by the user between the choices, determines whether to start or cancel the printing.

5. The image forming apparatus according to claim 4, wherein the hardware processor:

further causes the informing unit to inform the user of choices for the user to choose a printing method to perform the printing, the choices including a method of printing the first image of the job up to the continuously printable distance and a method of printing all the first image of the job by inserting a blank space at an interval of the continuously printable distance; and based on the chosen printing method for the job, causes the image former to perform the printing.

6. The image forming apparatus according to claim 4, wherein the hardware processor further causes the informing unit to inform the user of a method of extending the continuously printable distance.

7. The image forming apparatus according to claim 4, wherein the hardware processor further causes the informing unit to inform the user of the coverage.

8. The image forming apparatus according to claim 4, wherein the hardware processor:

further causes a display as the informing unit to display an image adjustment button for making an instruction to adjust the image information of the job; and if the image adjustment button is pressed, adjusts the image information of the job, thereby changing the continuously printable distance.

9. The image forming apparatus according to claim 1, wherein the hardware processor causes the informing unit to inform the user of the continuously printable distance before the user makes an instruction to start the printing.

10. The image forming apparatus according to claim 9, wherein the hardware processor further causes the informing unit to inform the user of a method of extending the continuously printable distance.

11. The image forming apparatus according to claim 9, wherein the hardware processor further causes the informing unit to inform the user of the coverage.

12. The image forming apparatus according to claim 9, wherein the hardware processor:

further causes a display as the informing unit to display an image adjustment button for making an instruction to adjust the image information of the job; and if the image adjustment button is pressed, adjusts the image information of the job, thereby changing the continuously printable distance.

13. The image forming apparatus according to claim 1, wherein the hardware processor:

if a printing distance for the job exceeds the continuously printable distance calculated from the image information of the job, causes a display as the informing unit to display an operation button for making an instruction to print, on the continuous paper, a second image for ejecting the toner in addition to the first image; and if the operation button is pressed, causes the image former to print the second image on the continuous paper when printing the first image on the continuous paper.

* * * * *